US009611717B2

(12) United States Patent
Lockwood

(10) Patent No.: US 9,611,717 B2
(45) Date of Patent: Apr. 4, 2017

(54) WELLHEAD ASSEMBLY WITH AN ANNULUS ACCESS VALVE

(71) Applicant: GE Oil & Gas UK Limited, Bridge of Don, Aberdeen (GB)

(72) Inventor: Mathew Frank Lockwood, Aberdeen (GB)

(73) Assignee: GE OIL & GAS UK LIMITED, Aberdeen (GB)

( * ) Notice: Subject to any disclaimer, the term of this patent is extended or adjusted under 35 U.S.C. 154(b) by 0 days.

(21) Appl. No.: 14/469,295

(22) Filed: Aug. 26, 2014

(65) Prior Publication Data

US 2016/0010417 A1 Jan. 14, 2016

Related U.S. Application Data

(60) Provisional application No. 62/024,260, filed on Jul. 14, 2014.

(51) Int. Cl.

| | |
|---|---|
| ***E21B 33/03*** | (2006.01) |
| ***E21B 33/035*** | (2006.01) |
| ***E21B 19/06*** | (2006.01) |
| ***E21B 34/02*** | (2006.01) |
| ***E21B 33/04*** | (2006.01) |

(52) U.S. Cl.

CPC ..... *E21B 34/02* (2013.01); *E21B 33/04* (2013.01)

(58) Field of Classification Search

CPC ..... E21B 33/03; E21B 34/02; E21B 33/035; E21B 34/06

USPC ... 166/368, 95.1, 344, 208, 97.1, 332.5, 373

See application file for complete search history.

(56) References Cited

U.S. PATENT DOCUMENTS

| | | | | |
|---|---|---|---|---|
| 4,154,298 A * | 5/1979 | Gano | ..... | 166/85.5 |
| 4,848,457 A | 7/1989 | Lilley | | |
| 4,869,318 A * | 9/1989 | Kellett | ..... | 166/321 |

(Continued)

FOREIGN PATENT DOCUMENTS

| | | |
|---|---|---|
| GB | 2342368 A | 4/2000 |
| GB | GE2394494 A | 4/2004 |

(Continued)

OTHER PUBLICATIONS

PCT Search Report and Written Opinion issued in connection with corresponding PCT Application No. PCT/IB2015/001696 on Dec. 4, 2015.

*Primary Examiner* — James G Sayre

(74) *Attorney, Agent, or Firm* — Hogan Lovells US LLP

(57) ABSTRACT

A wellhead assembly includes an annulus access valve (AAV) disposed in a wellhead hanger. Upper and lower annulus access bores intersect the bore at upper and lower ports. The AAV includes a body that reciprocates within the bore between open and closed positions. Hydraulic fluid moves the body between the open and closed positions. Axially spaced apart upper and lower apertures are formed through the body outer surface allow communication to a chamber within the body. When in the open position, the upper and lower apertures respectively register with the inlet and outlet ports so that the upper and lower annulus access bores are in communication through the AAV. When in the closed position, a solid portion of the body registers with one of the inlet or outlet ports, thereby blocking communication through the AAV between the upper and lower annulus access bores.

20 Claims, 6 Drawing Sheets

(56) References Cited

U.S. PATENT DOCUMENTS

| | | | | |
|---|---|---|---|---|
| 4,903,774 | A | 2/1990 | Dykes et al. | |
| 5,143,158 | A | 9/1992 | Watkins et al. | |
| 5,503,230 | A | 4/1996 | Osborne et al. | |
| 5,706,893 | A | 1/1998 | Morgan | |
| 5,769,162 | A * | 6/1998 | Bartlett et al. | 166/87.1 |
| 5,941,310 | A | 8/1999 | Cunningham et al. | |
| 6,186,237 | B1 | 2/2001 | Voss, Jr. et al. | |
| 6,302,212 | B1 | 10/2001 | Nobileau | |
| 6,367,551 | B1 | 4/2002 | Fenton | |
| 6,378,613 | B1 | 4/2002 | Kent et al. | |
| 6,488,083 | B2 | 12/2002 | Bartlett et al. | |
| 6,609,567 | B2 | 8/2003 | Ingram et al. | |
| 6,644,411 | B2 | 11/2003 | Compton et al. | |
| 6,679,330 | B1 | 1/2004 | Compton et al. | |
| 6,681,852 | B2 | 1/2004 | Baskett et al. | |
| 6,702,013 | B2 | 3/2004 | Bartlett | |
| 6,715,554 | B1 | 4/2004 | Cunningham et al. | |
| 6,729,392 | B2 * | 5/2004 | DeBerry et al. | 166/75.14 |
| 6,840,323 | B2 | 1/2005 | Fenton et al. | |
| 6,840,494 | B2 | 1/2005 | Cunningham | |
| 6,902,005 | B2 | 6/2005 | Radi et al. | |
| 6,942,028 | B2 | 9/2005 | Hosie | |
| 6,942,192 | B2 | 9/2005 | Cunningham | |
| 6,978,839 | B2 | 12/2005 | Fenton et al. | |
| 7,063,160 | B2 | 6/2006 | Fenton et al. | |
| 7,069,988 | B2 | 7/2006 | Bartlett et al. | |
| 7,219,741 | B2 | 5/2007 | Fenton et al. | |
| 7,350,580 | B1 | 4/2008 | Laureano | |
| 7,407,011 | B2 | 8/2008 | Kent | |
| 7,607,485 | B2 | 10/2009 | Fenton et al. | |
| 7,921,867 | B2 | 4/2011 | Groves, II | |
| 8,464,795 | B2 | 6/2013 | Dyson et al. | |
| 2002/0185280 | A1 * | 12/2002 | Cunningham et al. | 166/368 |
| 2003/0121667 | A1 * | 7/2003 | Massie | E21B 33/076 166/344 |
| 2004/0079910 | A1 * | 4/2004 | Cunningham | 251/62 |
| 2010/0101800 | A1 | 4/2010 | June et al. | |
| 2010/0116488 | A1 * | 5/2010 | Baskett et al. | 166/153 |
| 2015/0053412 | A1 * | 2/2015 | June | 166/348 |
| 2015/0114619 | A1 * | 4/2015 | Fenwick | 166/77.51 |

FOREIGN PATENT DOCUMENTS

| | | | |
|---|---|---|---|
| GB | 2427635 | B | 3/2008 |
| GB | 2448262 | A | 10/2008 |
| GB | 2448262 | B | 11/2008 |
| GB | 2422161 | B | 2/2009 |
| WO | WO 01/73256 | A1 | 10/2001 |
| WO | WO 01/73259 | A1 | 10/2001 |
| WO | WO 02/23006 | A2 | 3/2002 |
| WO | WO 03/067024 | A1 | 8/2003 |
| WO | WO 2004/022908 | A1 | 3/2004 |
| WO | WO 2011/036175 | A1 | 3/2011 |

* cited by examiner

WELLHEAD ASSEMBLY WITH AN ANNULUS ACCESS VALVE

CROSS REFERENCE TO RELATED APPLICATIONS

This application is a continuation of, and claims priority to and the benefit of, U.S. Patent Application Ser. No. 62/024,260, filed Jul. 14, 2014, the full disclosure of which is hereby incorporated by reference herein for all purposes.

BACKGROUND OF THE INVENTION

1. Field of Invention

The present disclosure relates in general to a system for selectively providing access to a wellbore annulus through a sidewall of a wellhead hanger. More specifically, the present disclosure relates to an annulus access valve in the side wall of a tubing hanger for controlling a flow of annular fluid.

2. Description of Prior Art

High pressure wellheads used in the production of hydrocarbons extracted from subterranean formations typically include a wellhead assembly attached at the upper end of a wellbore formed into a hydrocarbon producing formation. Wellhead assemblies usually provide support hangers for suspending production tubing and casing into the wellbore. The casing lines the wellbore, thereby isolating the wellbore from the surrounding formation, whereas the tubing usually inserts within the casing and provides a conduit therein for producing the hydrocarbons entrained within the formation. Wellhead assemblies also typically include a wellhead housing and a production tree atop the wellhead housing, where the wellhead housing circumscribes the hangers that support the casing and tubing. The production tree is commonly used to control and distribute the fluids produced from the wellbore, and to selectively provide fluid communication or access to the tubing, casing, and/or annuluses between the tubing and casing. Valves assemblies are typically provided within production trees for controlling fluid flow from a wellhead, such as production flow from the borehole or circulating fluid flow in and out of a wellhead.

Wellhead assemblies are usually mounted over a wellbore that intersects a subterranean formation and typically include a main bore that registers with the wellbore. Swab valves are generally set within the main bore for isolating the main bore and wellbore from ambient conditions above the wellhead assembly. Production from the wellbore is generally accomplished via a production line that intersects the main bore and extends laterally through a production tree. A production wing valve is generally provided within the production line for selectively regulating flow through the production flow line. Annulus line within a production tree usually includes an annulus wing valve for controlling flow therein. An annulus is defined between the tubing and casing which typically is in communication with the annulus line. Often, an annulus bleed line is included for annulus access or for venting of the annulus, and usually has one end connected to the annulus.

SUMMARY OF THE INVENTION

Described herein is an example of a wellhead assembly which includes a wellhead housing, a wellhead hanger disposed in the housing, a valve bore in a sidewall of the wellhead hanger, a valve body axially selectively reciprocal in the valve bore between open and closed positions, and upper and lower annulus access circuits in the sidewall of the wellhead hanger and that each intersect the valve bore at axially spaced apart locations and that are in communication with one another when the valve body is in the open position and that are out of communication when the valve body is in the closed position. A pressure source may be included that is selectively in communication with opposing ends of the valve body and for selectively reciprocating the valve body between the open and closed positions. In an example the valve body has an inner cavity, and upper and lower apertures formed through an outer surface of the body and that intersect the inner cavity at axially spaced apart locations, and wherein when the valve body is in the open position, the upper apertures register with the upper access circuit and the lower apertures register with the lower access circuit, so that the upper and lower access circuits are in communication with one another via the inner cavity. In an alternative, the valve body includes an inner cavity, and upper and lower apertures formed through an outer surface of the body and that intersect the inner cavity at axially spaced apart locations, and wherein when the valve body is in the closed position, a solid portion of the valve body is in a path of communication between the cavity and a one of the upper or lower apertures, so that communication between the upper and lower access circuits via the inner cavity is blocked by the solid portion of the valve body. Optionally included is an override assembly which is made up of a housing, a piston in the housing, and a latching assembly coupling the valve body to the piston, wherein the piston is selectively moveable to a first position and a second position, and wherein when the valve body is in the open position when the piston is in the first position, and the valve body is in the closed position when the piston is in the second position. In this example, further provided are pressure ports on the housing on opposing sides of the piston, so that when pressure is communicated to a one of the pressure ports, the piston is urged away from the one of the pressure ports. The latching assembly may be made from a sleeve with a profiled end that selectively couples with a profiled end on an override head, where the override head is attached to the valve body. The override assembly can be optionally mounted in a running tool that is used for landing the wellhead hanger in the wellhead housing. In one embodiment the wellhead hanger is a tubing hanger. An annulus can be formed which is defined between tubulars.

Also described herein is an example of a wellhead assembly which includes a wellhead housing, a wellhead hanger landed in the housing, an annulus defined between tubulars in the wellhead housing, an annulus access circuit having an end in communication with the annulus and that intersects the wellhead hanger, a valve member in the wellhead hanger that is selectively moved into a blocking position in the annulus access circuit to isolate portions of the annulus access circuit that are on opposing ends of the valve member, and a hydraulic circuit in selective communication with opposing sides of the valve member and that selectively urges the valve member into the blocking position. An override assembly may be further included which is moveable into a first position and a second position, and that is coupled to the valve member, so that when the override assembly is in the first position the valve member is in the blocking position, and so that when the override assembly is in the second position, the valve member is spaced away from the blocking position. This embodiment may further have a latching assembly on the override assembly that selectively engages an override head that couples to the valve member, and wherein the latching assembly comprises a sleeve with a profiled end that inserts into an upper end of the override head that is shaped complimentary to the profiled end. The override assembly may include a piston housed in a cylinder, and wherein a hydraulic fluid source selectively delivers pressurized hydraulic fluid to opposing ends of the piston for moving the override assembly between the first and second positions. The annulus access circuit may be made up of an upper portion that extends from a bore in the wellhead hanger having the valve member to an upper portion of the wellhead hanger and that is distal from the annulus. The annulus access circuit may optionally include a lower portion that extends from a bore in the wellhead hanger having the valve member to a lower portion of the wellhead hanger and that is proximate the annulus. In one embodiment, the hydraulic circuit has a pressurized fluid passage formed through the wellhead hanger having an end in communication with a pressure source.

BRIEF DESCRIPTION OF DRAWINGS

Some of the features and benefits of the present invention having been stated, others will become apparent as the description proceeds when taken in conjunction with the accompanying drawings, in which.

Figure 1:
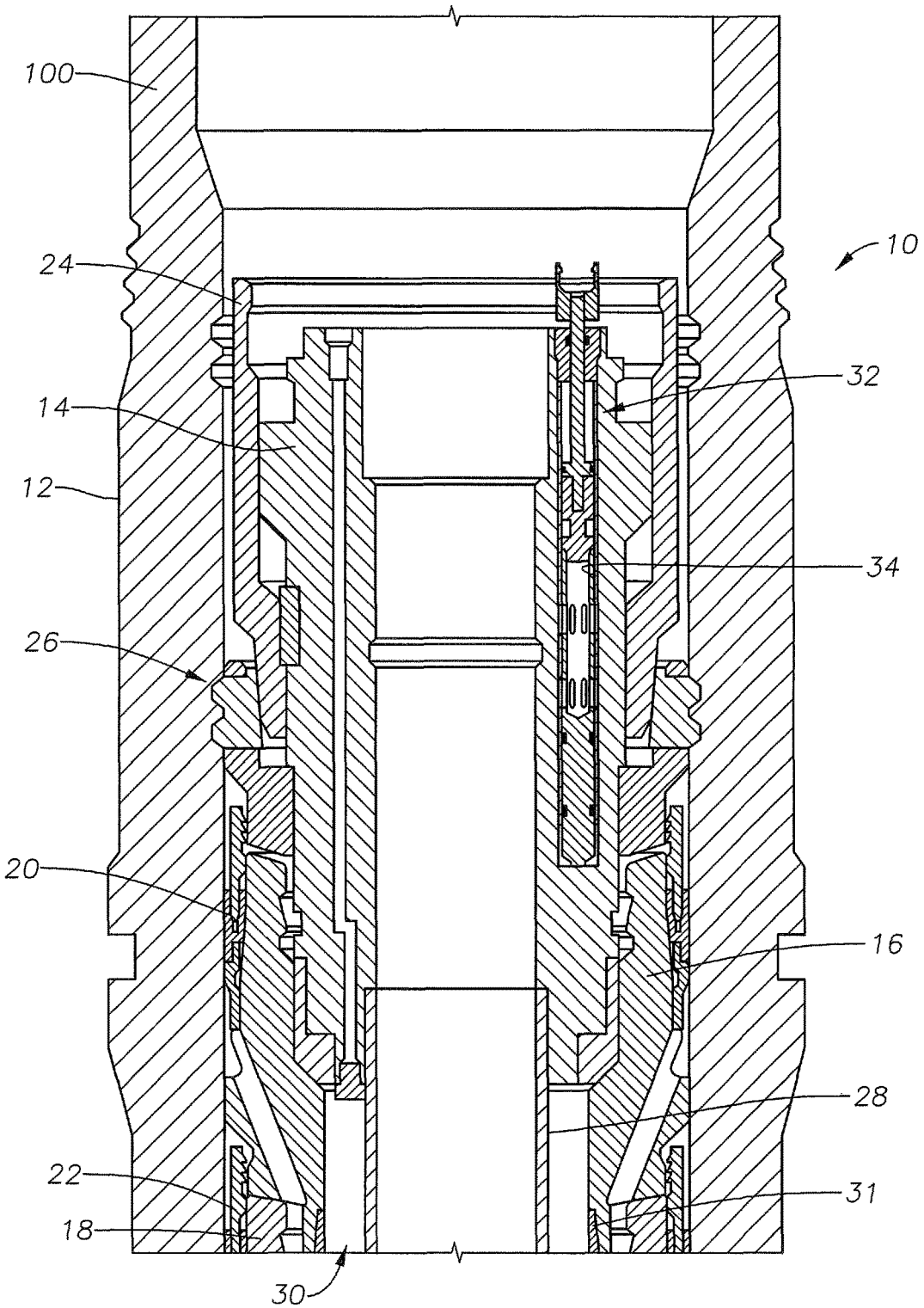
FIG. 1 is a side sectional view of an example of an annulus access valve disposed within a wellhead hanger, which in turn is landed within a wellhead assembly.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 shows in cross sectional view one example of a wellhead assembly 10 made up of an annular wellhead housing 12 and which has a tubing hanger 14 landed therein. Tubing hanger 14 is an annular member and is shown landed on top of a casing hanger 16, which in turn lands on an outer casing hanger 18 within wellhead housing 12. Seal assemblies 20, 22 seal the interface between the casing hangers 16, 18 and wellhead housing 12. Circumscribing an upper portion of tubing hanger 14 is an actuation sleeve 24 shown behind locking dogs 26 that are mounted to an inner surface of wellhead housing 12. Driving actuation sleeve 24 downward pushes dogs 26 radially outward to lock tubing hanger 14 in wellhead assembly 10. A string of tubing 28 connects to a lower end of tubing hanger 14 and depends downward into a well (not shown) that is disposed beneath wellhead assembly 10. An annulus 30 is formed between the tubing 28 and inner surface of casing hanger 16; casing 31 shown mounted on a lower end of casing hanger 16. An example of an annulus access valve 32 is illustrated disposed in a valve bore 34; where valve bore 34 is axially formed within a sidewall of tubing hanger 14. As will be described in more detail below, annulus access valve 32 provides selective communication between the annulus 30 and locations above wellhead assembly 10.

Figure 2A:
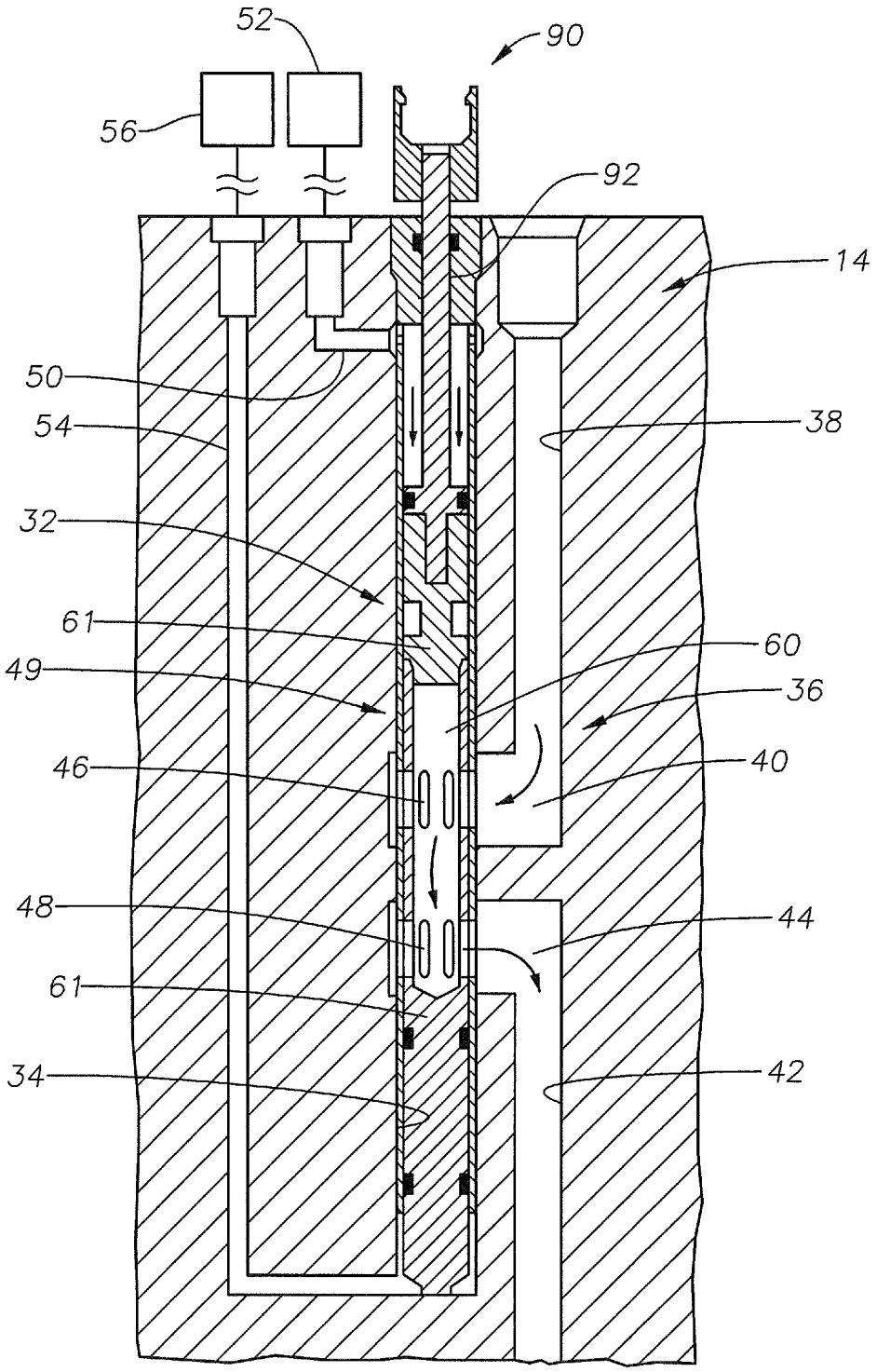
FIGS. 2A and 2B are side sectional views of an example of the annulus access valve of FIG. 1 respectively n open and closed positions.
Figure 2B:
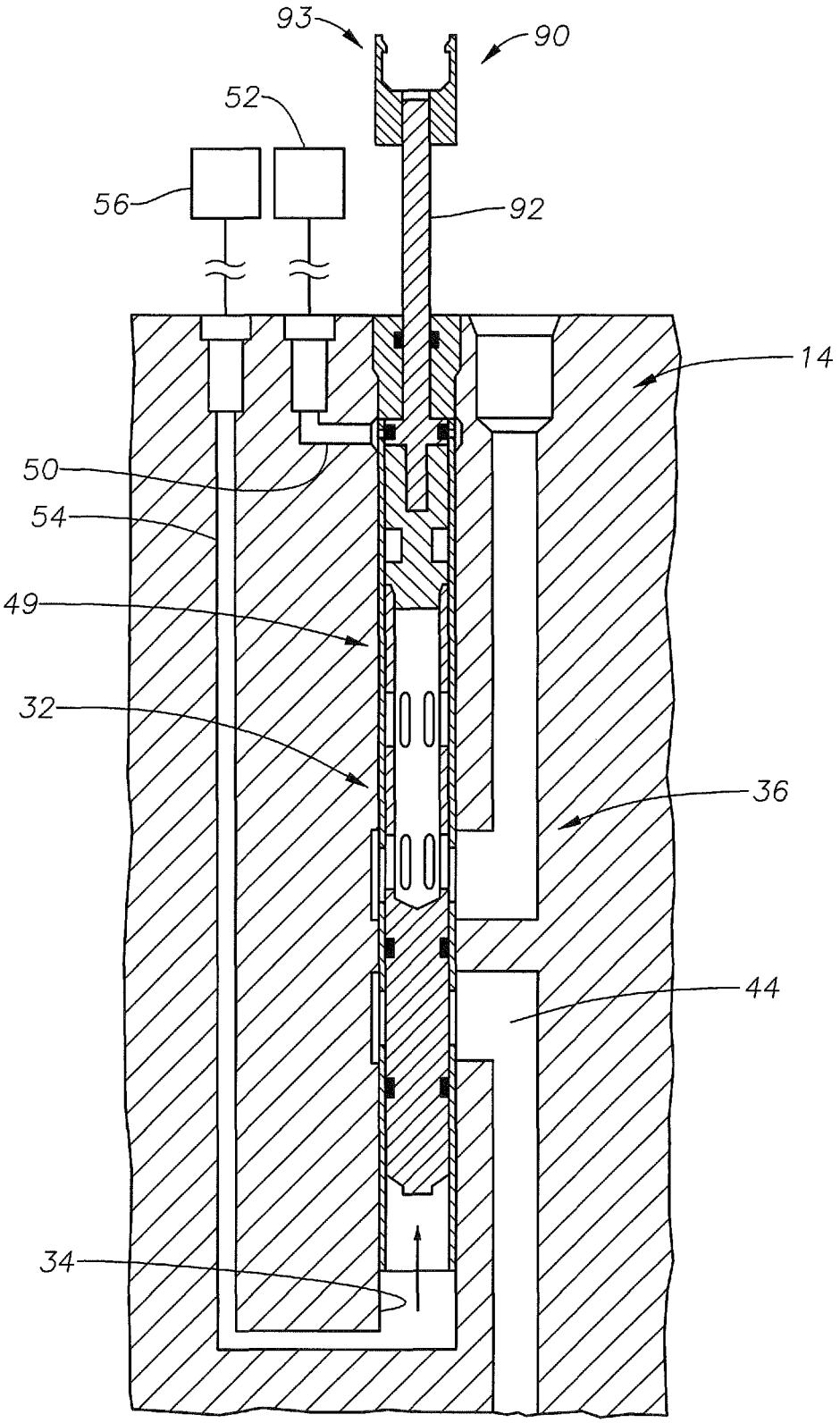

FIGS. 2A and 2B show in a side sectional view detailed examples of the annulus access valve 32 set in the tubing hanger 14. In FIG. 2A annulus access valve 32 is in an open position, which allows the annulus 30 (FIG. 1) may be accessed from locations above tubing hanger 14. The path for providing communication to annulus 30 is through an annulus access circuit 36 shown made up of an upper annulus access bore 38. Upper annulus access bore 38 is shown axially projecting through tubing hanger 14 and offset from valve bore 34. An upper annulus access port 40 extends laterally through tubing hanger 14 from a lower end of upper annulus access bore 34 and intersects with valve bore 34. Upper annulus access bore 38 thus communicates with valve bore 34 via upper annulus access port 40. Circuit 36 further includes a lower annulus access bore 42 shown axially formed through the tubing hanger 14 below upper annulus access port 40. Lower annulus access bore 42 has an upper end intersecting a lower annulus access port 44, where lower annulus access port 44 intersects with valve bore 34 at a location that is axially spaced away from where upper annulus access port 40 intersects with valve bore 34. Lower annulus access bore 42 is in communication with annulus 30 (FIG. 1); thus valve bore 34 is in selective communication with annulus 30 via lower annulus access port 44 and lower annulus access bore 42. Upper and lower apertures 46, 48 are provided in a sidewall of the body 49 of the annulus access valve 32. In the example, upper apertures 46 are adjacent the intersection between valve bore 34 and upper annulus access port 40, and lower apertures 48 are adjacent where lower annulus access port 44 intersects with valve bore 34.

A fluid supply line 50 is shown formed through the tubing hanger 14 and has one end intersecting with an upper portion of valve bore 34 proximate an upper terminal end of tubing hanger 14. An opposite end of fluid supply line 50 connects to a fluid source 52 distal from its intersection of valve bore 34. Fluid source 52 can be any source of pressurized fluid, such as a pump, a pressurized vessel or a combination thereof. Moreover, fluid source 52 may be proximate wellhead assembly 10, or remotely located, such as above sea surface. Another fluid supply line 54 is shown formed through tubing hanger 14 and which intersects a lower portion of valve bore 34; and at a location distal from intersection between fluid supply line 50 and valve bore 34. Fluid source 56 connects to an end of fluid supply line 54 and opposite from its connection to valve bore 34. Examples exist where fluid source 52 and fluid source 56 are combined within a single unit and/or are at the same general location.

Still referring to FIG. 2A, further illustrated is a chamber 60 formed within valve body 49 which projects axially within valve body 49 above the upper apertures 46 and below the lower apertures 48. Upper and lower apertures 46, 48 project through a sidewall of valve body 49 and thereby allowing communication from the outer surface of valve body 49 and into chamber 60. As such, in the example of FIG. 2A and with annulus access valve 32 in the open position, fluid communication (as illustrated by the arrows) is provided through valve body 49 into upper apertures 46, through chamber 60, and out lower apertures 48. Thus, upper and lower access ports 40, 44 may be in communication with one another via the path shown that extends through apertures 46, through chamber 60, and through aperture 48. Moreover, in the example of FIG. 2A pressurized fluid from fluid source 52 is provided to fluid supply line 50 and applied to a side of valve body 49 which urges valve body 49 into the position shown and allowing the above described communication through circuit 36, and thereby allowing access to annulus 30 through annulus access valve 32.

Referring now to FIG. 2B, shown is an example of the annulus access valve 32 in a closed configuration. In this example, pressurized fluid is provided to fluid supply line 54 via fluid source 56, and delivered to a lower end of valve body 49 thereby urging valve body upward and away from the intersection with valve bore 34 and fluid supply line 54. As shown, the valve body 49 includes solid portions 61 above and below the chamber 60. In this example, the solid portion 61 of valve body 49 below chamber 60 is adjacent lower annulus access port 44, thereby blocking communication between chamber 60 and lower annulus access port 44. The illustrated closed configuration thus blocks communication to annulus 30 (FIG. 1) through annulus access valve 32. In one embodiment, fluid within valve bore 34 above valve body 49 may be bled from valve bore 32 and into fluid supply line 50 to allow the upward movement of valve body 49. Thus, by selectively activating fluid sources 52, 56 and flowing fluid through one of fluid supply lines 50, 54 to the valve bore 34, the valve body 49 may be cycled upward and downward into open and closed positions to selectively allow and/or block annulus access through the annulus access valve 32.

Figure 3:
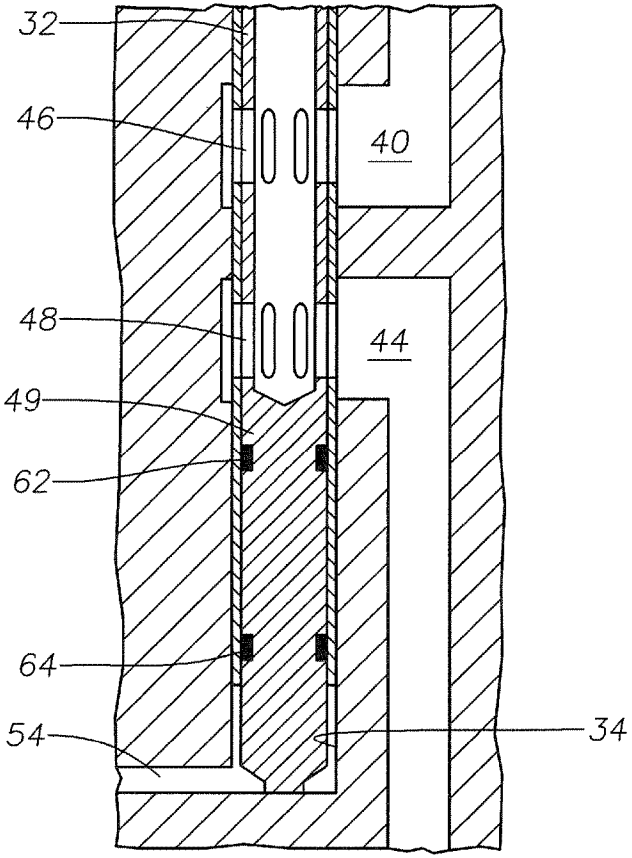
FIG. 3 is a side sectional detail view of an example of the annulus access valve of FIG. 1.

FIG. 3 illustrates a detailed example of a portion of the annulus access valve 32 and further shows seals 62, 64 circumscribing the valve body 49. Seals 62, 64 provide sealing capability to isolate fluid delivered to valve bore 34 on one side of the valve body 49 from the opposing side of the valve body 49. Further in the example of FIG. 3, apertures 46, 48 are respectively registered with ports 40, 44 thereby putting the annulus access valve 32 into an open position and allowing access to annulus 30 (FIG. 1).

Figure 4:
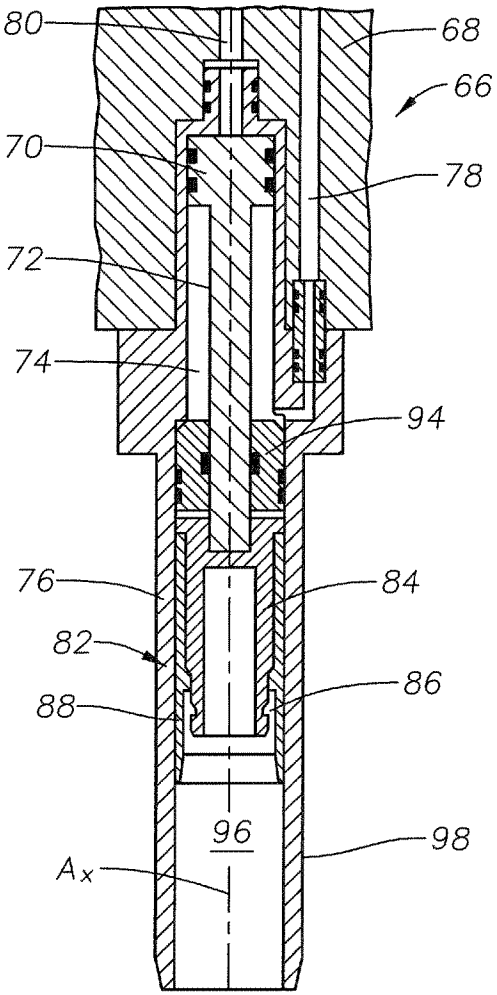
FIG. 4 is a side sectional view of an example of an override assembly for use with the annulus access valve of FIG. 1.

FIG. 4 shows in a side sectional view one example of an override assembly 66 that provides a redundant means for operating the annulus access valve 32 (FIG. 2A, 2B) in the event of hydraulic failure to the tubing hanger 14. In this example, override assembly 66 can be provided within a running tool 68 that may be used for landing the tubing hanger 14 (FIG. 1) into the wellhead assembly 10. Alternatively, override assembly 66 is provided within a production tree 100 shown mounted onto housing 12 (FIG. 1). Included within the override assembly 66 is a piston head 70, piston rod 72 attaches to a lower end of piston head 70. Both piston head 70 and piston rod 72 are disposed within a cylinder 74 defined within a housing 76. Hydraulic lines 78, 80 are shown formed through the body of the running tool 68 and intersect housing 76 on opposite ends of piston head 70. Thus, selectively delivering pressurized fluid to hydraulic lines 78, 80 may reciprocate piston head 70 and piston rod 72 within housing 76. Coupled to a lower end of piston rod 72 distal from piston head 70 is a latching assembly 82 that is shown made up of a latching sleeve 84; which is an annular member and has a groove circumscribing its outer surface and proximate its lower end. Latching sleeve 84 is circumscribed by an outer sleeve 88 that is in close contact with an inner surface of housing 76. In the example, the sleeves 84, 88 are generally coaxial with one another and circumscribe an axis AX of the housing 76.

Figure 5A:
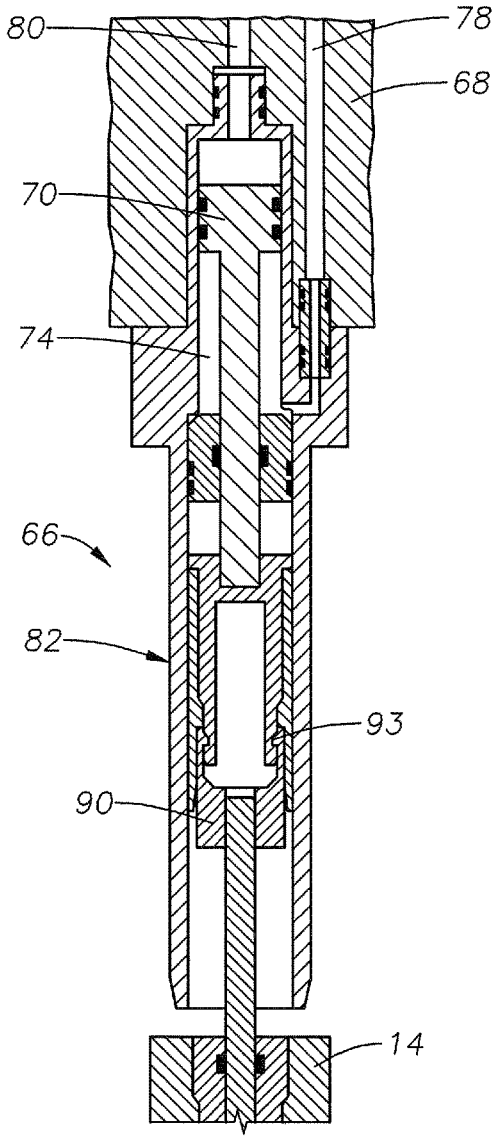
FIGS. 5A-5D illustrate in side sectional views examples of operation of the override assembly of FIG. 4.
Figure 5B:
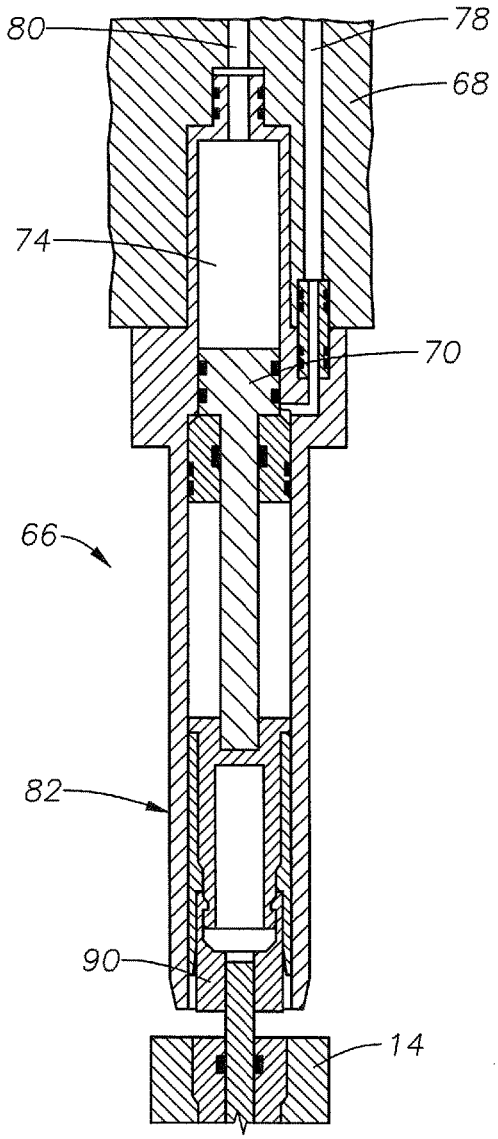
Figure 5C:
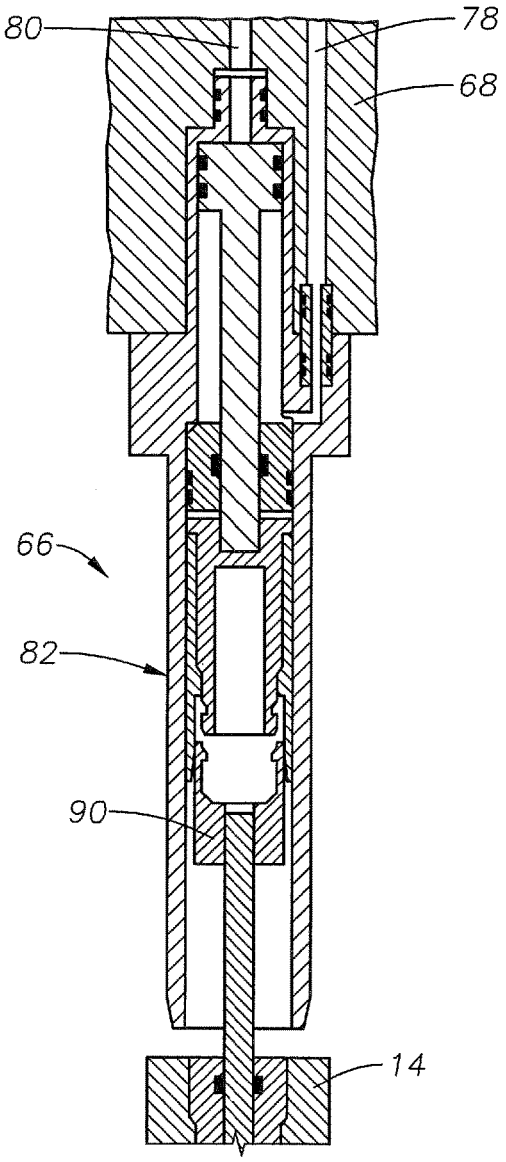
Figure 5D:
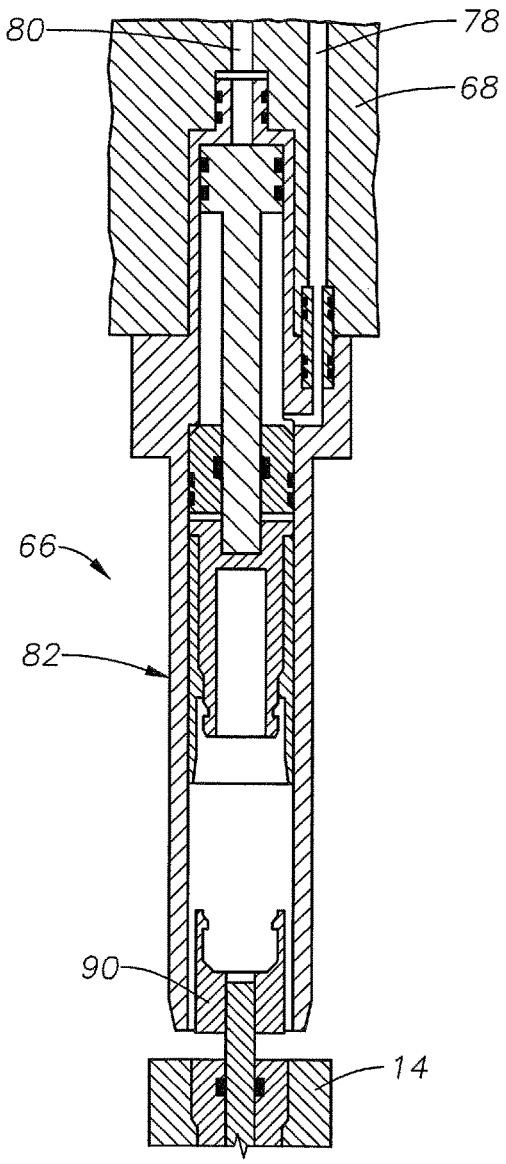

In one example of use, the latching assembly 82 couples with the annulus access valve 32 via an override head 90, shown attached to annulus access valve 32 via rod 92 (FIG. 2A, 2B). Override head 90 has a generally cylindrical base with a sleeve-like portion that projects upward from the base. Proximate the upper terminal end of the sleeve on the override head 90 is a profile 93 designed for attaching to groove 86 on the lower end of sleeve 84. An example of this coupling is illustrated in FIGS. 5A, 5B where the override assembly 66 has been coupled to override head 90. In FIGS. 5A, 5B up and down movement of the override head 90 is achieved by axially upward and downward movement of the piston head 70 and piston rod 72 as described above. More specifically, in FIG. 5A, pressurized fluid has been delivered into cylinder 74 from hydraulic line 78 thereby upwardly moving piston head 70 within cylinder 74, and in turn drawing override head 90 upward as well. In this configuration, and as can be seen in FIG. 2B, the annulus access valve 32 is positioned into a closed position. Similarly, by venting fluid from cylinder 74 and into hydraulic line 78, while introducing fluid into cylinder 74 above piston head 70 and from hydraulic 80, latching assembly 82 and override head 90 are urged downward thereby putting the annulus access valve 32 into a closed position, as illustrated in FIG. 2A.

Referring back to FIG. 4, the override assembly 66 is shown further equipped with a cylindrically-shaped bulkhead 94 that mounts into the housing 76 and below where hydraulic line 78 intersects with cylinder 74. Piston rod 72 reciprocatingly inserts through bulkhead 94, and seals are provided on the outer and inner circumferences of bulkhead 94 so that any fluid within cylinder does not make it way downward past bulkhead 94 and to the latching assembly 82. A cavity 96 is defined within the housing lower portion 98 which is the portion of the housing 76 below bulkhead 94. Housing lower portion 98 provides a means for covering the latching assembly 82 and structural support for coupling the override assembly 66 to the tubing hanger 14 and for coupling with the override head 90.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A wellhead assembly comprising:

a wellhead housing having an axis;

a wellhead hanger disposed in the housing;

a valve bore in a sidewall of the wellhead hanger, the valve bore having a diameter less than a radial width of the sidewall;

a valve body axially selectively reciprocal in the valve bore between open and closed positions;

a first groove on an outer diameter of the valve body containing a first seal, the first seal being annular and removable with the valve body;

a second groove on an outer diameter of the valve body containing a second seal, the second seal being annular and removable with the valve body;

upper and lower annulus access circuits in the sidewall of the wellhead hanger that each intersect the valve bore at axially spaced apart locations and that are in communication with one another when the valve body is in the open position and that are out of communication when the valve body is in the closed position, a valve body pressure source selectively in communication with opposing ends of the valve body and for selectively axially reciprocating the valve body between the open and closed positions;

an override head secured to an upper end of the valve body;

an override assembly selectively positioned on top of the wellhead hanger, the override assembly having an override bore, a piston in the override bore, and a latching assembly coupled to the piston for axial movement with the piston, the latching assembly having a latch on a lower end that is engageable with the override head;

a fluid pressure down stroke passage leading to the override bore above the piston for stroking the piston and the latching assembly downward;

a fluid pressure up stroke passage leading to the override bore below the piston for stroking the piston upward; wherein in the event of failure of the valve body pressure source, fluid pressure supplied to the down stroke passage causes the latch to move downward and couple to the override head, and fluid pressure subsequently supplied to the up stroke passage lifts the valve body upward.

2. The wellhead assembly of claim 1, wherein:

the latch and the override head having mating profiles comprising a rib and a groove that snap into engagement with each other when the latch couples to the override head.

3. The wellhead assembly of claim 1, wherein the valve body comprises an inner cavity, and upper and lower apertures formed through an outer surface of the body and that intersect the inner cavity at axially spaced apart locations, and wherein when the valve body is in the open position, the upper apertures register with the upper access circuit and the lower apertures register with the lower access circuit, so that the upper and lower access circuits are in communication with one another via the inner cavity.

4. The wellhead assembly of claim 1, wherein the valve body comprises an inner cavity, and upper and lower apertures formed through an outer surface of the body and that intersect the inner cavity at axially spaced apart locations, and wherein when the valve body is in the closed position, a solid portion of the valve body is in a path of communication between the cavity and a one of the upper or lower apertures, so that communication between the upper and lower access circuits via the inner cavity is blocked by the solid portion of the valve body.

5. The wellhead assembly of claim 1, wherein, the latching assembly of the override assembly further comprises a rod connected between the piston and the latch; and the override assembly further comprises a rod seal in the override bore between the piston and the latch that seals around the rod; and wherein the up stroke passage enters the override bore between the rod seal and the piston.

6. The wellhead assembly of claim 5, wherein the latch comprises:

an inner sleeve in the override bore;

an outer sleeve in the override bore surrounding the inner sleeve, the outer sleeve being axially movable with the inner sleeve, protruding below the inner sleeve, and configured to slide over the override head when the latch couples to the override head, the inner sleeve being configured to slide into a recess in the override head when the latch couples to the override head; and wherein the inner sleeve and the override head have mating profiles that cause the inner sleeve to snap into engagement with the override head when the latch couples to the override head.

7. The wellhead assembly of claim 5, wherein the override assembly further comprise:

a housing having an interior that defines the override bore, the housing extending downward past the latch while the piston is in a lowermost position.

8. The wellhead assembly of claim 5, wherein the override assembly is mounted in a running tool that is used for landing the wellhead hanger in the wellhead housing.

9. The wellhead assembly of claim 5, wherein the override assembly is mounted in a subsea tree that is landed on the wellhead housing.

10. The wellhead assembly of claim 1, wherein the wellhead hanger is a tubing hanger.

11. The wellhead assembly of claim 1, wherein the valve body comprises a cylindrical member having a valve body axis that coincides with an axis of the valve bore.

12. A wellhead assembly comprising:

a wellhead housing having an axis;

a wellhead hanger landed in the housing, the wellhead hanger having an annulus valve bore in a sidewall of the wellhead hanger;

an annulus defined between tubulars in the wellhead housing;

an annulus access circuit having an end in communication with the annulus and that intersects the annulus valve bore in the wellhead hanger;

a valve member in the valve bore, the valve member having a diameter less than a radial width of the sidewall of the wellhead hanger, and that is selectively axially movable into a blocking position in the annulus access circuit and has a first seal and a second seal that are removable with the valve member to isolate portions of the annulus access circuit that are on opposing ends of the valve member when the valve member is in the blocking position;

a valve member hydraulic circuit in selective communication with the opposing ends of the valve member and that selectively axially moves the valve member axially in the valve bore between the blocking position and an open position;

a valve rod secured to the valve member, extending upward in the valve bore and protruding above the wellhead hanger, the valve rod being axially movable in unison with the valve member, a valve rod seal at an upper end of the valve bore that seals the valve rod to the valve bore;

an override head secured to an upper end of the valve rod above the valve bore;

an override assembly selectively positioned on top of the wellhead hanger, the override assembly having an override bore, a piston in the override bore, and a latching assembly coupled to the piston for axial movement with the piston, the latching assembly having a latch on a lower end that is engageable with the override head;

a fluid pressure down stroke passage leading to the override bore above the piston for stroking the piston and the latching assembly downward into engagement with the override head;

a fluid pressure up stroke passage leading to the override bore below the piston for stroking the piston upward; wherein in the event of failure of the valve member hydraulic circuit, fluid pressure supplied to the down stroke passage causes the latch to move downward and couple to the override head, and fluid pressure subsequently supplied to the up stroke passage moves the latch and the valve body upward in unison.

13. The wellhead assembly of claim 12, wherein, the latch and the override head have mating profiles that latch into engagement with each other when the latch is moved downward against the override head.

14. The wellhead assembly of claim 13, wherein the latching assembly further comprises an override rod connected between the piston and the latch; and the override assembly further comprises an override rod seal in the override bore that seals around the override rod between the piston and the latch, and wherein the up stroke passage enters the override bore between the override rod seal and the piston.

15. The wellhead assembly of claim 13, wherein the latching assembly comprises:

an inner sleeve in the override bore;

an outer sleeve in the override bore surrounding the inner sleeve, the outer sleeve being axially movable with the inner sleeve, protruding below the inner sleeve, and configured to slide over the override head when the latch couples to the override head, the inner sleeve being configured to slide into a recess in the override head when the latch couples to the override head; and wherein the inner sleeve and the override head have mating profiles that cause the inner sleeve to snap into engagement with the override head when the latch couples to the override head.

16. The wellhead assembly of claim 12, wherein the override assembly further comprises:

a housing having an interior that defines the override bore, the housing extending downward past the latch while the piston is in a lowermost position.

17. The wellhead assembly of claim 12, wherein the valve member comprises a cylindrical member having a valve body axis that coincides with an axis of the valve bore.

18. The wellhead assembly of claim 12, wherein the hydraulic circuit comprises a pressurized fluid passage formed through the wellhead hanger having an end in communication with a pressure source.

19. A wellhead assembly comprising:

a wellhead housing having a central axis;

a wellhead hanger disposed in the housing;

a valve bore in a sidewall of the wellhead hanger;

a valve body axially selectively axially reciprocal in the valve bore between open and closed positions;

upper and lower annulus access circuits in the sidewall of the wellhead hanger and that each intersect the valve bore at axially spaced apart locations and that are in communication with one another when the valve body is in the open position and that are out of communication when the valve body is in the closed position;

a first groove on an outer diameter of the valve body containing a first seal, the first seal being annular and removable with the valve body;

a second groove on an outer diameter of the valve body containing a second seal, the second seal being annular and removable with the valve body;

a valve rod secured to the valve body, extending upward in the valve bore and protruding above the wellhead hanger, the valve rod being axially movable in unison with the valve body, a valve rod seal at an upper end of the valve bore that seals the valve rod to the valve bore;

a valve body pressure source selectively in communication with the valve bore at opposing ends of the valve body for selectively axially reciprocating the valve body between the open and closed positions;

an override head secured to an upper end of the valve rod above the valve bore;

an override housing selectively positioned on top of the wellhead hanger, the override housing having an override bore;

a piston in the override bore;

an override rod secured to and extending downward in the override bore from the piston;

a latch on a lower end of the override rod, the latch and the override head having mating profiles that snap the latch and the override head into engagement with each other when the latch is moved downward into contact with the override head;

a fluid pressure down stroke passage leading to the override bore above the piston for stroking the piston, the override rod and the latch downward, a fluid pressure up stroke passage leading to the override bore below the piston for stroking the piston, the override rod and the latch upward;

an override rod seal sealing around the override rod in the override bore between the piston and the latch, wherein in the event of failure of the valve body pressure source, fluid pressure supplied to the down stroke passage causes the latch to move downward and connect to the override head; and fluid pressure subsequently supplied to the up stroke passage moves the latch and the valve body upward in unison.

20. The wellhead assembly of claim 19, wherein a central axis of the valve bore extends through the sidewall and is offset from the central axis of the wellhead hanger.

* * * * *